US006484897B1

(12) United States Patent
Crawley

(10) Patent No.: US 6,484,897 B1
(45) Date of Patent: Nov. 26, 2002

(54) CONTAINERS WITH VARIABLE VOLUME

(75) Inventor: Alan Mark Crawley, Christchurch (NZ)

(73) Assignee: Amcad Holdings Limited, Christchurch (NZ)

( * ) Notice: Subject to any disclaimer, the term of this patent is extended or adjusted under 35 U.S.C. 154(b) by 0 days.

(21) Appl. No.: 09/619,765

(22) Filed: Jul. 19, 2000

Related U.S. Application Data

(63) Continuation-in-part of application No. 08/894,147, filed on Aug. 12, 1997, now abandoned.

(30) Foreign Application Priority Data

Feb. 13, 1995 (NZ) ..... 270488

(51) Int. Cl.[7] ..... B65D 21/08; B65D 51/16

(52) U.S. Cl. ..... 215/307; 215/311; 215/379; 215/382; 220/8

(58) Field of Search ..... 215/20, 307, 311, 215/900, 11.3, 379, 382; 220/578, 580, 216, 227, 367.1, 8

(56) References Cited

U.S. PATENT DOCUMENTS 3,256,977 A * 6/1966 Pettersen
3,847,304 A * 11/1974 Cohen ..... 222/95 X
3,955,698 A 5/1976 Hammer
3,987,941 A * 10/1976 Blessing
4,046,279 A * 9/1977 Rosler ..... 220/8
4,142,657 A * 3/1979 Wanke
4,429,811 A 2/1984 Bakeman
4,450,982 A 5/1984 Ferreira
4,456,134 A 6/1984 Cooper
4,596,340 A * 6/1986 Luther ..... 220/8
4,796,785 A * 1/1989 Merritt
4,873,100 A * 10/1989 Dirksing et al.
5,186,361 A * 2/1993 Williams ..... 222/95
5,219,091 A * 6/1993 Paramski
5,238,150 A 8/1993 Williams
5,282,549 A * 2/1994 Scholz et al. ..... 220/95
5,356,037 A 10/1994 Harrold
RE36,377 E * 11/1999 Gilbert ..... 222/95 X
6,105,803 A * 8/2000 Standish

FOREIGN PATENT DOCUMENTS

| | | |
|---|---|---|
| AU | 91166/82 | 12/1982 |
| DE | 36 06 711 | 9/1987 |
| EP | 0 167 482 | 1/1986 |

* cited by examiner

*Primary Examiner*—Nathan J. Newhouse
(74) *Attorney, Agent, or Firm*—Jacobson Holman PLLC

(57) ABSTRACT

A container of variable volume includes an inner flexible member substantially enclosed in a number of interlocking outer sleeves. The volume of the container can be varied by moving at least one outer sleeve relative to another outer sleeve. The outer sleeves are moved to vary the volume of the container by rotating screw-threaded outer sleeves, moving an outer sleeve relative to another by a ratchet, or by using a multi-level bayonet type connection.

19 Claims, 5 Drawing Sheets

CONTAINERS WITH VARIABLE VOLUME

This is a continuation-in-part of U.S. Ser. No. 08/894,147, filed Aug. 12, 1997, now abandoned.

BACKGROUND

The present invention relates to a container wherein the volume of the container can be varied so as to minimise the amount of air in the container.

Containers are generally of fixed volume. It is usually necessary to have a number of containers of different sizes as it is well known that food will last longer if its contact with air is minimised. Also having containers larger than is necessary sometimes presents a problem, especially when space is at a premium.

Another problem often encountered is that of aerated drinks going "flat" or losing carbonation when stored. This is a result of the gas escaping from the drink into the neighbouring air.

It is an object of this invention to provide a container having a variable volume which will attempt to overcome the above disadvantages, or which will at least provide the public with a useful alternative choice.

According to one aspect of the present invention there is provided a container comprising an inner flexible member substantially enclosed in a number of inseparable and interlocking outer sleeves, wherein the volume of the inner flexible member container can be varied by moving at least one outer sleeve relative to another outer sleeve.

The outer sleeves remain inseparable during normal telescoping operation and can only be separated by the User via a mechanism for this express purpose.

The interlocking sleeves can be screw threaded together so that by twisting the sleeves relative to each other the volume of the member can be varied.

The interlocking sleeves can alternatively move relative to each other by means of a ratchet. An upper sleeve can include at least two series of externally projecting teeth. A handle on a lower sleeve can be provided to act as a pawl for each series of externally projecting teeth. To decrease the volume of the container, the upper sleeve can be pushed downwards towards and into the lower sleeve. To release the sleeves and hence to increase the volume of the container, the handles can be used, or the upper and lower sleeves can be rotated relative to each other.

The interlocking sleeves can alternatively move relative to each other by means of a multi-level bayonet connection. The multi-level bayonet connection alternatively is formed by providing in either an upper or lower sleeve opposed grooves, each set of grooves comprising a plurality of transverse grooves connected by a longitudinal groove. At least two pin members can extend from the adjacent lower sleeve or upper sleeve to fit one into each set of grooves in the other sleeve. Rotation of the upper and lower sleeves causes the transverse pins to move in the transverse grooves to the longitudinal groove and hence to vary the volume of the container in a push/pull and twist action.

The inner flexible member can be fixed to the base of the lower sleeve by means of a pin. The inner flexible member can be welded to the upper sleeve.

Alternatively, a lip of the inner flexible member can protrude through an opening in the container, hence providing a seal between the inner flexible member and a cap. This allows the inner flexible member to be removed completely from the outer sleeves.

The inner flexible member can be concertina or balloon-like.

The container can be sealed by means of the cap, the cap including a threaded skirt with a float mounted therein. The float has a skirt mounted thereon or formed integrally therewith and a button section. As the volume of the container is decreased by moving one outer sleeve relative to another outer sleeve, air can escape through a passage between the outer edge of the skirt and inner surface of the cap and threaded skirt. Once a liquid or other flowable material reaches the float, the float rises, gradually shutting off the escape of air when the skirt contacts the inner surface of the cap.

According to a further aspect of the invention, there is provided a variable volume container comprising an exterior casing with an inner flexible bladder, the internal volume of which is adjusted by moving one end of the bladder by any suitable means so that in use the volume of the flexible bladder and the volume of its contents are substantially the same.

BRIEF DESCRIPTION OF DRAWINGS

Further aspects of the invention will become apparent from the following description which is given by way of example with reference to the accompanying drawings in which.

DETAILED DESCRIPTION

Figure 1:
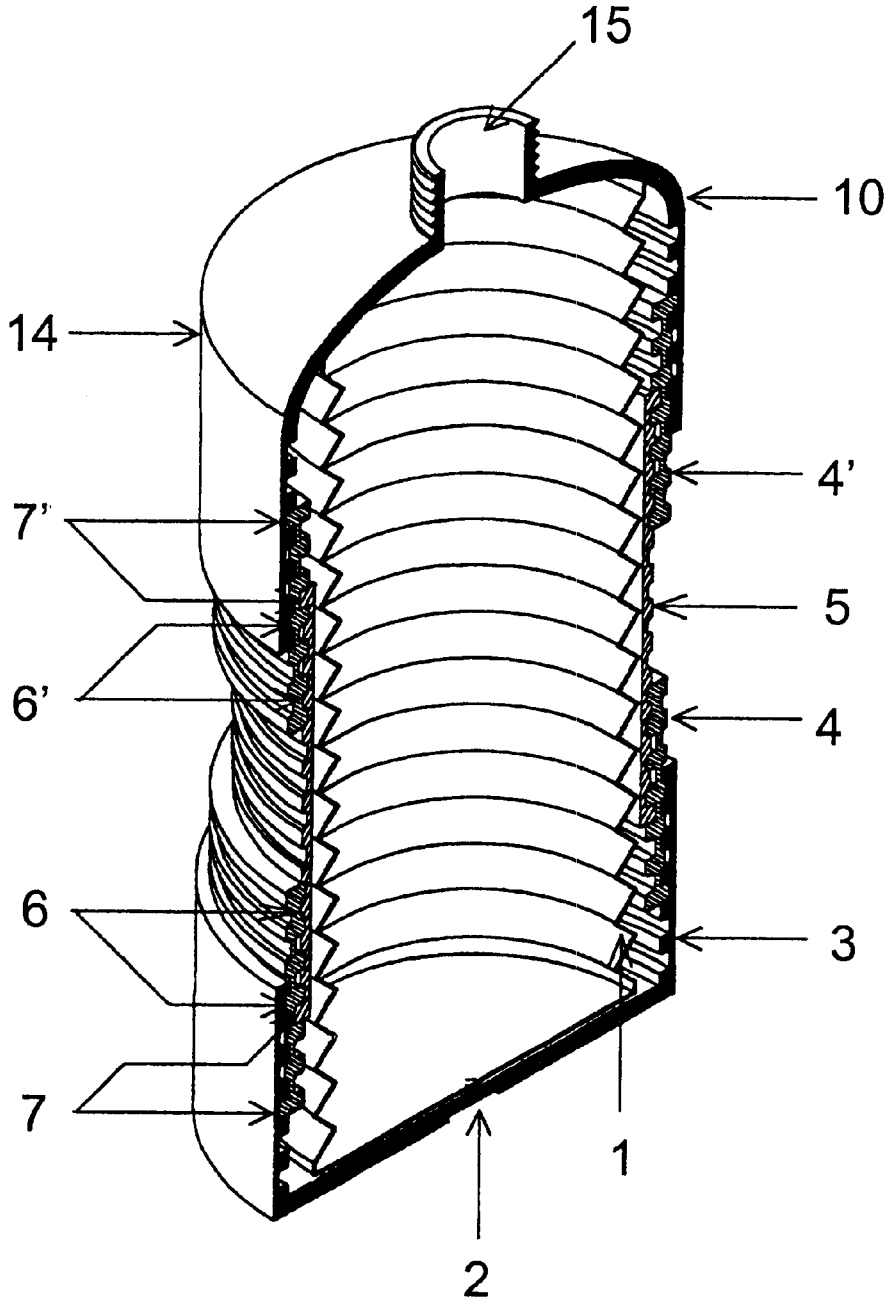
FIG. 1 shows a vertical three-dimensional sectional view of the container according to one embodiment of the present invention.

In the example seen in FIG. 1, the container 10 includes an inner flexible member 1. This inner member 1 is concertina, and permanently attached to upper sleeve 14. The inner member 1 is attached by a pin 2 to the bottom sleeve 3, allowing the bottom sleeve 3 and inner member 1 to rotate independently. The bottom sleeve 3 and upper sleeve 14 have the same diameters, and both have an internal thread. The height of the bottom sleeve 3 and upper sleeve 14 is substantially one sixth of the height of the container when fully extended.

Bottom sleeve 3 interlocks with section 4. Section 4 is threaded on both sides, so as to interlock with bottom sleeve 3 and centre section 5. A similar section 4' to section 4 fits between centre section 5 and upper sleeve 14. Sections 4 and 4' are substantially one sixth of the container height when fully extended, and centre section 5 is substantially one third of the height of the container when fully extended.

The uppermost internal thread 6 in each section of sleeve 3 and 4 and the lower most internal thread 6' of each section 4' and 14 has a different smaller thread contour to the remaining thread. Conversely, the lower most external thread 7 in each section 4 and 5 and the uppermost external thread 7' in each section 4' and 5 has greater thread contours. The combination of these contours prevents the threaded sections 3, 4, 4', 5 and 14 from separating because of frictional engagement therebetween.

Thus, the threaded sections and sleeves 3, 4, 4', 5 and 14 can be screwed downwards to one third of the container's full height. When the threaded sections 3, 4, 4', 5 and 14 are screwed upwards, the full container height is achieved and the sizes of threads 6 and 7 prevent the sections and sleeves 3, 4, 4', 5 and 14 coming apart. Thus interlocking sleeves 3, 4, 4', 5 and 14 form an inseparable telescoping container.

At the top of upper sleeve 14, there is an external threaded opening 15, onto which a cap 9 fits. The cap 9 includes a threaded skirt 8, skirt 13 and float 11. The threaded skirt 8 interlocks with threaded opening 15.

Figure 2:
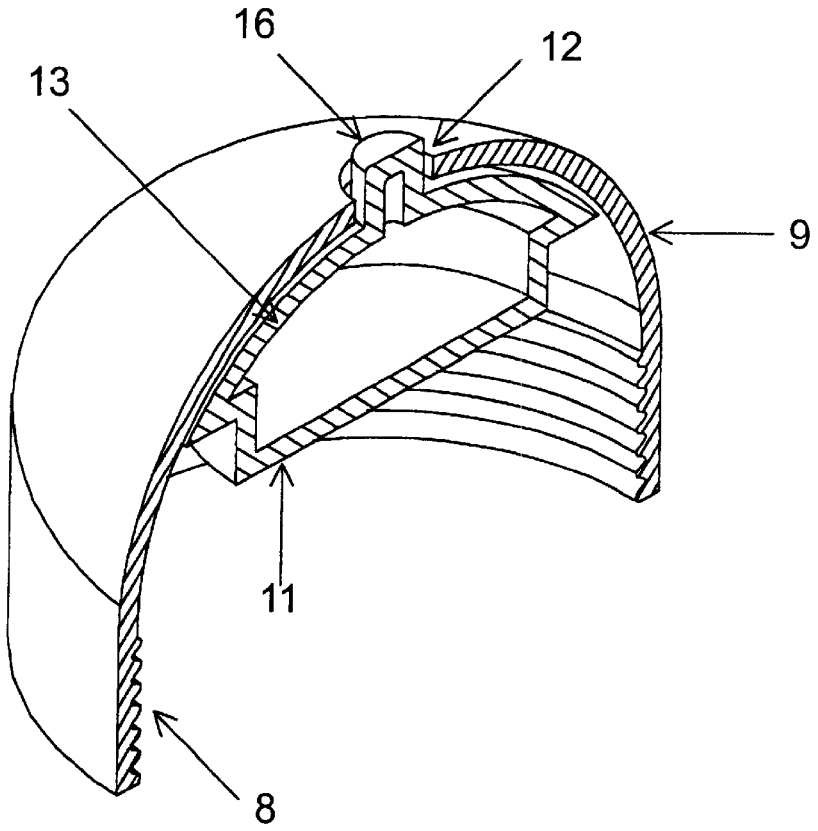
FIG. 2 shows a three-dimensional sectional view of one half of the cap according to one embodiment of the present invention.

FIG. 2 shows part of the cap 9. When the sections and sleeves 3, 4, 4', 5 and 14 are screwed down to reduce the volume of the container 10, air can escape from the container 10 by way of passage 12 between threaded skirt 8 and skirt 13. The lowering of cap 9 causes float 11 to come into contact with and float on any liquids or other flowable material in the member 1. This gradual rising of float 11, and consequentially skirt 13, causes passage 12 to be blocked and the container 10 to be sealed. Any further internal pressure, either from further reducing the internal volume or gases escaping from the liquid, will increase the sealing effect of the cap 9.

If the skirt 13 ever jams up against closure 8, finger pressure on button section 16 will open the cap and allow further air to escape.

Figure 3:
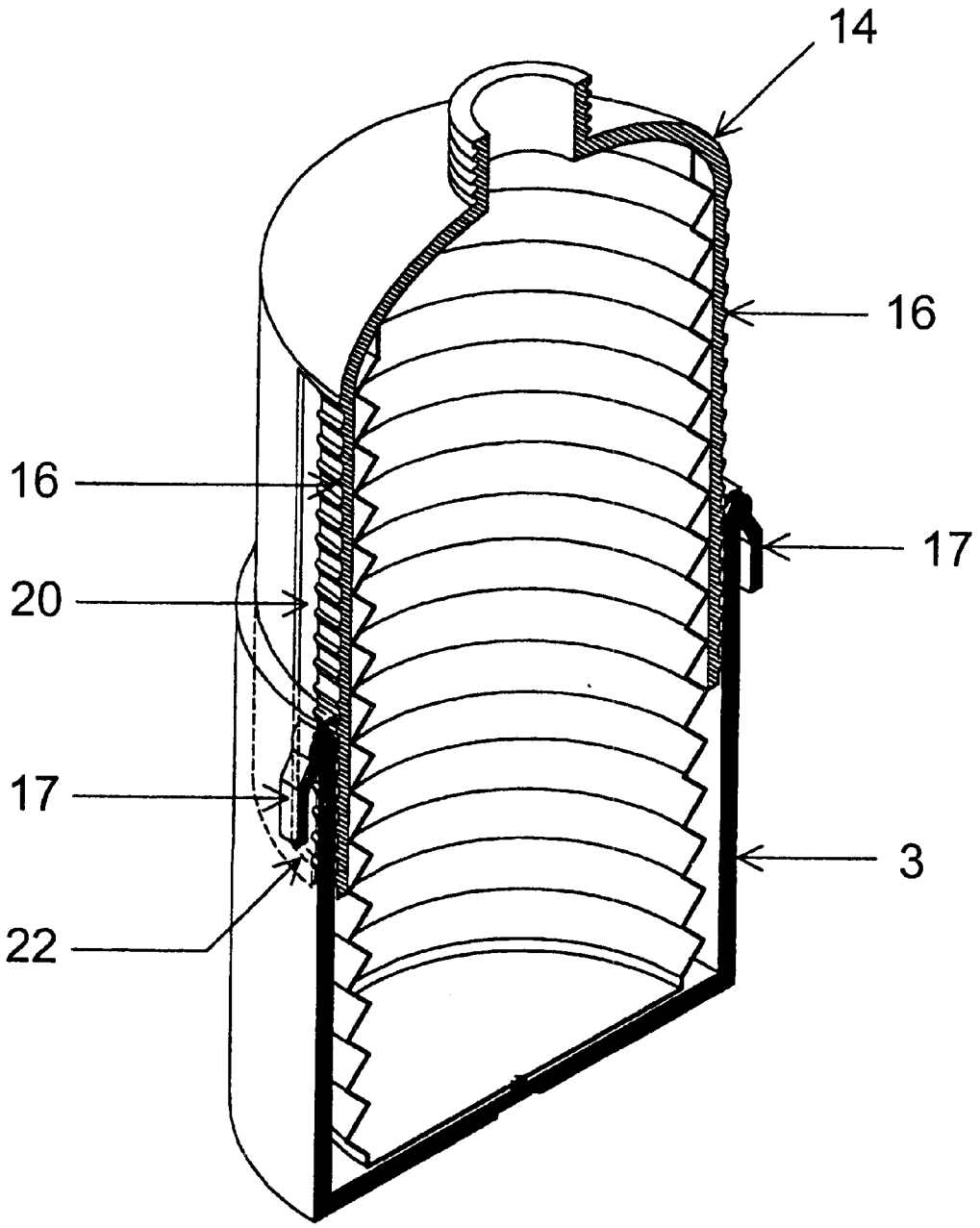
FIG. 3 shows a three-dimensional cross-sectional view of a container according to another embodiment of the invention.

FIG. 3 shows another embodiment of the invention, wherein the volume of the container is varied by means of a ratchet and pawl mechanism. The upper sleeve 14 has two sets of externally projecting teeth 16. It is to be appreciated that more than two sets may be provided. A pawl handle 17 is provided on the lower sleeve 3. To decrease the volume of the container, the upper sleeve is pushed downwards towards the lower sleeve. The pawl inner end of the pawl handle 17 locks in the teeth 16 to maintain a particular volume for the container. Movement of the handle 17 can release the ratchet mechanism, in order for the volume of the containers to be increased. Alternatively, rotation of the upper and lower sleeve 14, 3 may be used to release the ratchet, so as to increase the volume of the container. A longitudinal groove 20 allows the handle 17 to free from the teeth 16 and thus the sleeves 3 and 14 to freely telescope. A shoulder at the end of the longitudinal groove 22 ensures that the interlocking sleeves remain inseparable. The handles 17 can be used by the User to unlock and separate the sleeves 3 and 14 if desired.

Figure 4:
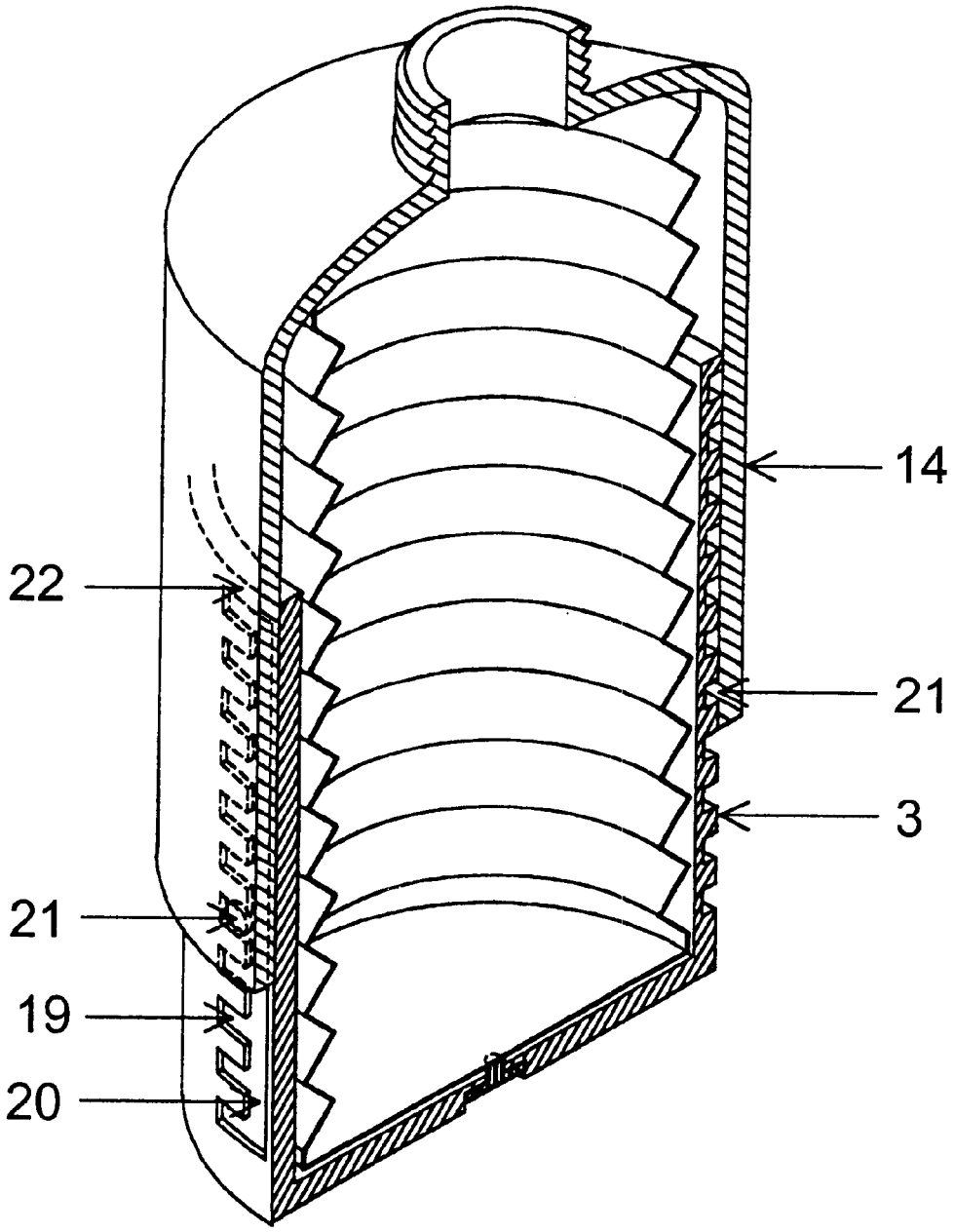
FIG. 4 shows a three-dimensional cross-sectional view of a container according to another embodiment of the invention.

FIG. 4 shows yet another embodiment of the invention, wherein the volume of the container is varied by means of multi-level bayonet type connections. The connection in the example has the lower sleeve 3 with two sets of shaped grooves, each set comprising a plurality of transverse grooves 19 connected by a longitudinal groove 20. Upper sleeve 14 has a pin member 21 which fits into grooves 19, 20. By moving (Twisting and pushing/pulling) the upper sleeve 14 relative to lower sleeve 3, or vice versa, the member 21 can move between transverse grooves 19 by means of the longitudinal groove 20, and hence vary the volume of the container. A shoulder 22 at the end of the longitudinal groove 20 ensures that the interlocking sleeves 3 and 14 remain inseparable.

Figure 5:
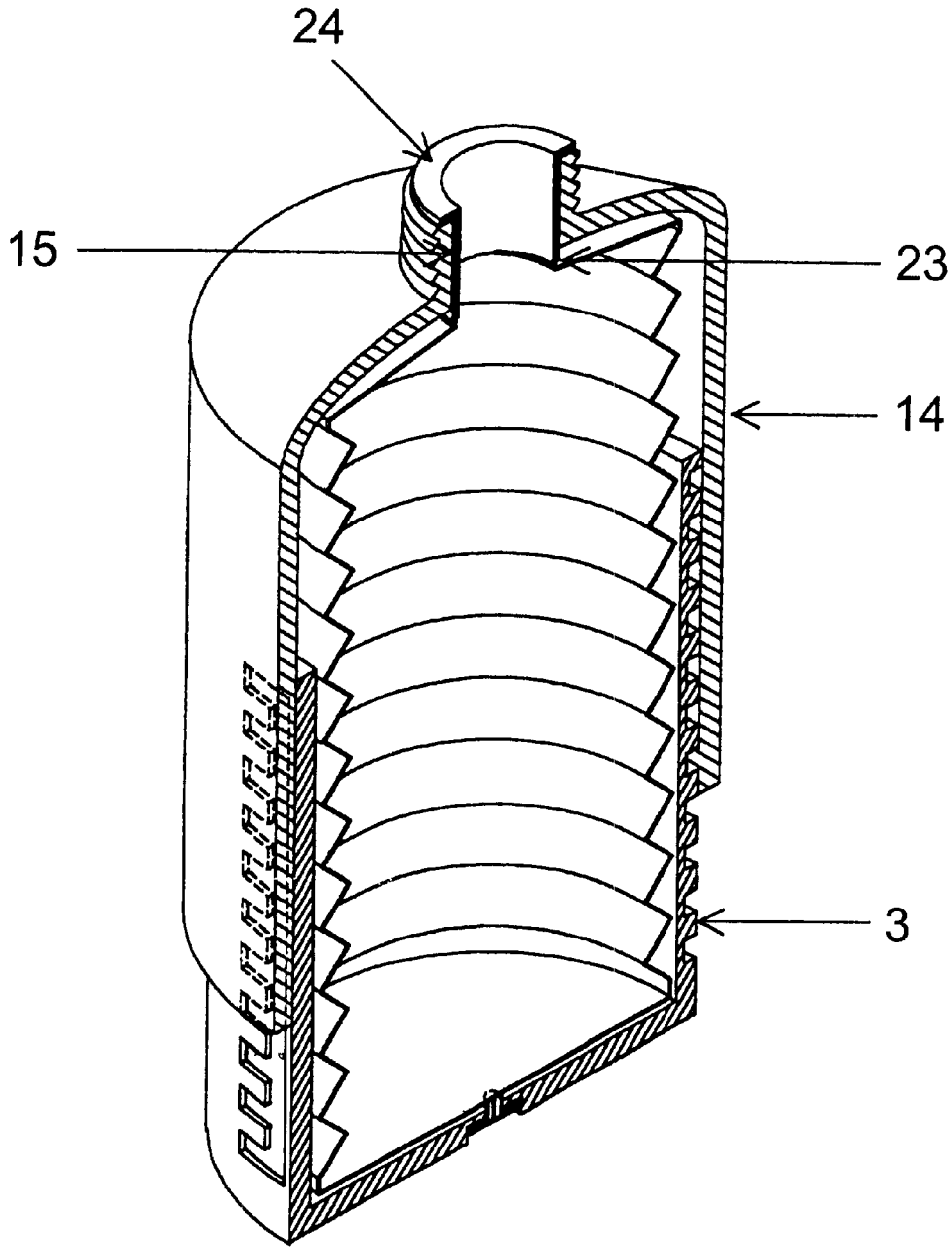
FIG. 5 shows a three-dimensional cross-sectional view of a container according to a further embodiment of the invention.

FIG. 5 shows the container of figure four, however in this embodiment the inner flexible member 1 is attached 23 to a lip 24 that protrudes through the opening 15 of the container.

It will thus be seen that the present invention provides a container wherein the volume of the container can be varied so as to minimise the amount of air in the container.

Where in the aforegoing description, reference has been made to integers or components having known equivalents, then such equivalents are herein incorporated as if individually set forth.

Although this invention has been described by way of example and with reference to possible embodiments thereof, it is to be appreciated that improvements and/or modifications may be made thereto without departing from the scope or spirit of the invention, and in the appended claims.

What is claimed is:

1. A variable volume container and cap assembly, the container including means allowing the internal volume thereof to be varied and the cap including a closure and skirt, the skirt having a float and a button assembly arranged so that when the volume of the container is decreased and a flowable material in the internal volume reaches the float, the float gradually shuts off a passage between an outer edge of the skirt and an inner surface of the closure, the air escaping through the passage between the outer edge of the skirt and the inner surface of the closure.

2. A container and cap assembly according to claim wherein the container includes an inner flexible member substantially enclosed in a number of interlocking sleeves wherein a volume of the inner flexible member is varied by moving at least one outer sleeve relative to another outer sleeve, and adjacent outer sleeves are inseparable.

3. A container and cap assembly according to claim 2, wherein the sleeves are telescoping sleeves.

4. A container and cap assembly according to claim 3, further comprising an upper outer sleeve and a lower outer sleeve.

5. A container and cap assembly according to claim 4, wherein the upper outer sleeve has an externally threaded opening.

6. A container and cap assembly according to claim 5, wherein the inner flexible member is fixed to the base of the lower outer sleeve.

7. A container and cap assembly according to claim 6, wherein the inner flexible member is permanently secured to the upper outer sleeve.

8. A container and cap assembly according to claim 6, wherein a lip of the inner flexible member protrudes through the externally threaded opening so as to provide a seal between the inner flexible member and the cap.

9. A container and cap assembly according to claim 6, wherein the outer sleeves are screw threaded together.

10. A container and cap assembly according to claim 6, wherein the outer sleeves move relative to each other by a ratchet.

11. A container and cap assembly according to claim 10, wherein the upper sleeve includes at least two sets of externally projecting teeth.

12. A container and cap assembly according to claim 11, wherein a pawl handle on the lower sleeve is provided for each set of externally projecting teeth.

13. A container and cap assembly according to claim 12, wherein movement of the handle between teeth causes the ratchet to be released, and hence the volume of the container to increase.

14. A container and cap assembly according to claim 11, wherein rotation of the upper and lower sleeves enables the volume of the container to be varied.

15. A container and cap assembly according to claim 6, wherein outer sleeves move relative to each other by a multi-level bayonet connection.

16. A container and cap assembly according to claim 15, wherein the bayonet connection is formed in one of the lower and the upper sleeve with at least two sets of shaped grooves, each set of grooves comprising a plurality of transverse grooves connected by a longitudinal groove.

17. A container and cap assembly according to claim 16, wherein at least two pin members extend from one of the lower and upper sleeve and each pin member fits into a set of shaped grooves in the other sleeve.

18. A container and cap assembly according to claim 17, wherein rotation of the upper and lower sleeves causes the pin member to move in a twist or push/pull action between the transverse grooves by the longitudinal groove and hence to vary the volume of the container.

19. A container and cap assembly according to claim 1 wherein the container includes an inner flexible member substantially enclosed in a number of interlocking sleeves wherein a volume of the inner flexible member is varied by moving at least one outer sleeve relative to another outer sleeve, and adjacent outer sleeves are only separable by release of an interlocking mechanism, the interlocking mechanism being such that the interlocking mechanism allows the container to telescope whilst remaining integral with the container.

* * * * *